US009587879B1

(12) United States Patent
Mersinas

(10) Patent No.: US 9,587,879 B1
(45) Date of Patent: Mar. 7, 2017

(54) PLASTIC BAG DRYING DEVICE

(71) Applicant: Constantine T Mersinas, Mary Esther, FL (US)

(72) Inventor: Constantine T Mersinas, Mary Esther, FL (US)

( * ) Notice: Subject to any disclaimer, the term of this patent is extended or adjusted under 35 U.S.C. 154(b) by 339 days.

(21) Appl. No.: 14/458,183

(22) Filed: Aug. 12, 2014

(51) Int. Cl.
*A47F 5/00* (2006.01)
*A47G 29/00* (2006.01)
*F26B 9/00* (2006.01)
*A47F 13/08* (2006.01)

(52) U.S. Cl.
CPC ..... *F26B 9/00* (2013.01); *A47F 13/085* (2013.01)

(58) Field of Classification Search
CPC ..... F26B 9/00; F26B 21/006; B65D 81/264; B65D 81/265; B65D 81/267; B65D 81/268; B65D 51/30; A47F 13/085; A47F 5/0006; A47F 9/042
USPC ..... 211/85.12, 12, 183; 34/80, 81, 104, 95; 206/204, 523
See application file for complete search history.

(56) References Cited

U.S. PATENT DOCUMENTS 896,536 A * 8/1908 Hayden ..... A43D 3/1491 12/114.2
3,131,036 A * 4/1964 Hirschberg ..... A43D 3/1408 12/128 B
3,295,694 A 1/1967 Nejezchleb et al.
4,497,080 A * 2/1985 Inspector ..... A43D 3/1416 12/128 R
5,080,237 A 1/1992 Hefner
5,102,076 A * 4/1992 North ..... A47L 19/00 211/DIG. 1
5,188,244 A * 2/1993 Hollstegge ..... D06F 59/00 211/13.1
5,247,752 A 9/1993 Gyr et al.
D342,357 S 12/1993 Balk
5,291,669 A * 3/1994 Khoury ..... A43D 3/1433 12/128 B
5,303,827 A * 4/1994 Ross ..... D06F 59/00 211/85.15
5,405,018 A * 4/1995 Anthrop, Jr. ..... A47L 15/505 211/41.9
5,421,542 A * 6/1995 Crutcher ..... F26B 25/18 248/95
D375,815 S * 11/1996 Kagasoff ..... D21/793
D377,552 S 1/1997 Papadea
5,641,137 A 6/1997 Collier
5,794,792 A 8/1998 Convertino
5,901,861 A * 5/1999 Huguet ..... F26B 25/18 211/85.15

(Continued)

*Primary Examiner* — Jennifer E Novosad
(74) *Attorney, Agent, or Firm* — Peter Loffler

(57) ABSTRACT

A plastic bag drying device uses a body member that has a base with upwardly and inwardly tapering side faces and end faces and a wedge shaped body wedge extending upwardly from a top of the base. The base and the body wedge may be monolithic in construction and are made from an appropriate moisture absorbent material, such as sponge or foam. Baggies are placed atop the body wedge and held open by the device and allowed to air dry any moisture within the baggie not already absorbed by the body itself. An optional slot allows two smaller baggies to be fitted over the body wedge. An expander wedge can be placed onto the body wedge in order to accommodate relatively large baggies.

23 Claims, 5 Drawing Sheets

(56) References Cited

U.S. PATENT DOCUMENTS

| | | | | |
|---|---|---|---|---|
| 5,950,323 | A * | 9/1999 | Wroth | A43D 3/1491 12/128 B |
| 6,234,916 | B1 * | 5/2001 | Carusillo | A63B 55/10 473/286 |
| 6,243,967 | B1 * | 6/2001 | Dovolas | F26B 25/18 211/13.1 |
| 6,378,224 | B1 * | 4/2002 | Qualkinbush | A43B 3/0026 34/104 |
| 6,640,982 | B1 | 11/2003 | Bjerke | |
| 6,675,493 | B1 | 1/2004 | Martin | |
| D583,429 | S * | 12/2008 | Worth | D21/718 |
| 7,475,785 | B1 * | 1/2009 | Kidd | A47L 19/02 211/200 |
| 7,699,913 | B2 * | 4/2010 | Grieve | A43B 17/102 252/194 |
| D627,097 | S * | 11/2010 | Rothenberg | D27/192 |
| 8,439,768 | B1 * | 5/2013 | Shah | A24F 13/22 131/257 |
| 8,807,501 | B2 * | 8/2014 | Chung | B25H 3/04 211/70.8 |
| 9,265,315 | B1 * | 2/2016 | Frid | A45C 1/02 |
| 2012/0324752 | A1 * | 12/2012 | Jon | F26B 9/003 34/106 |
| 2013/0160273 | A1 * | 6/2013 | Schuetz | A47F 5/0876 29/428 |
| 2015/0368851 | A1 * | 12/2015 | Bickham | D06F 55/00 24/532 |

* cited by examiner

PLASTIC BAG DRYING DEVICE

BACKGROUND OF THE INVENTION

1. Field of the Invention

The present invention relates to a simple device that receives one or more plastic bags and allows them to dry thereon.

2. Background of the Prior Art

Small plastic bags, commonly referred to as baggies, are very versatile as they can hold a multitude of items in a secure and air tight manner. From PB&J sandwiches for the kids, to fruits and vegetables, to soups and other items, baggies can be found in lunch boxes everywhere. Baggies are also great for longer term food storage, both in the refrigerator and the freezer, providing an airtight seal that helps prevent premature spoilage of the item being held. Baggies also have utility outside of the kitchen as they are used to hold everything from nuts and bolts to sewing items to small parts being used during a device assembly. In short, the baggie is an indispensable item in most homes and garages.

Although an individual baggie is relatively inexpensive, especially when measured against its versatility and utility, baggies are not without any costs, especially the larger baggies and the thicker baggies that are used for freezer storage and possibly liquid storage such as soup or a smoothie.

Many individuals address baggie costs by reusing them until they wear out or otherwise tear, unless the baggie has become contaminated, such as by storing raw meat. In order to reuse a baggie, the individual washes the baggie and thereafter allows the baggie to air dry. Once the baggie is dry, it is reused. While effective in lowering usage costs, and decreasing the environmental costs, the problem in reuse occurs in the drying process. Baggies, by their design, tend to at least partially close in their normal relaxed state. Not only does this closure not facilitate proper drying of the inside of the baggie, it can foster the growth of mold and mildew within the baggie, thereby rendering the baggie unusable, requiring discarding of the baggie.

To address this issue, various devices have been proposed that act as a drying rack in order to assist in the baggie drying process. Such devices, which come in a variety of architectures, suffer from one or more drawbacks. Some devices are unusually complex and expensive, thereby making such devices economically unattractive to potential consumers. Some devices hold a substantial portion of the baggie open, yet allow the corners to remain somewhat closed, thereby preventing full drying at the corners so that mold and mildew growth can occur.

What is needed is a device that allows a baggie to dry after being washed, which device addresses the above stated shortcomings in the art. Such a device must be of relatively simple design and construction so as to be relatively inexpensive to produce so as to be economically attractive to potential consumers for this type of device. Such a device must hold the entire internal cavity of the baggie in an open state to allow full drying of the entire interior of the baggie.

SUMMARY OF THE INVENTION

The plastic bag drying device of the present invention addresses the aforementioned needs in the art by providing a device that receives one or more baggies thereon and not only allows the baggies to air dry, but also actively facilitates the drying process. The plastic bag drying device is of simple design and construction, being produced using standard manufacturing techniques, so that the device is relatively inexpensive to produce so that the plastic bag drying device is economically attractive to potential consumers for this type of item. The plastic bag drying device allows for the entire interior of the baggie to be properly dried and deodorized.

The plastic bag drying device of the present invention is comprised of a base that has a flat bottom, a pair of opposing side faces that taper upwardly and inwardly toward each other, and a pair of opposing end faces that taper upwardly and inwardly toward each other. A wedge shaped body wedge extends upwardly from a top of the base. The body wedge has a pointed first top edge and a pair of pointed first side edges. The base and the body wedge are each made from a moisture absorbent material, such as sponge, foam, terrycloth, etc. The base and the body wedge are monolithic in construction. An optional slot extends from the first top edge of the wedge body toward the base. The base may be mounted on a base mount. An optional wedge shaped expander wedge may be provided. The expander wedge has a bottom with a hollow interior extending into the expander wedge from the bottom. The expander wedge also has a pointed second top edge and a pair of pointed second side edges. The expander wedge is seated atop the body wedge by having the interior receive a portion of the body wedge therein.

BRIEF DESCRIPTION OF THE DRAWINGS

Similar reference numerals refer to similar parts throughout the several views of the drawings.

DESCRIPTION OF THE PREFERRED EMBODIMENT

Figure 1:
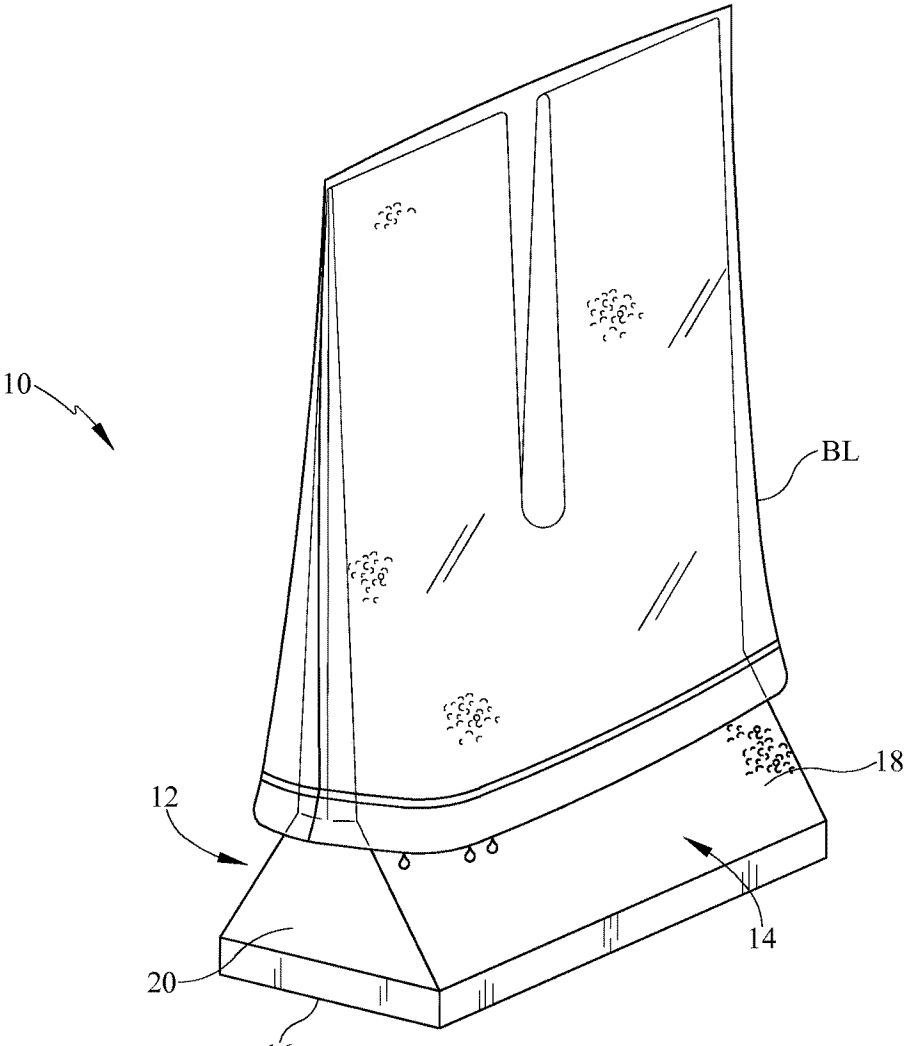
FIG. 1 is a perspective view of the plastic bag drying device of the present invention drying a relatively larger plastic bag.

Referring now to the drawings, it is seen that the plastic bag drying device of the present invention, generally denoted by reference numeral 10, is comprised of a body member 12 that has a base 14 that has a relatively flat bottom 16 and upwardly and inwardly tapering side walls 18 and upwardly and inwardly tapering end walls 20. Extending upwardly from the base 14 is a body wedge 22 that has a pointed top edge 24 as well as pointed side edges 26. An optional slot 28 extends from the top edge 24 of the body wedge 22 to the medial portion of the body wedge 22. The slot 28 may, but need not necessarily be located midway between the side edges 26 of the body wedge 22. The body member 12 is made from a moisture absorbent material, such as sponge, open or closed cell foam, terrycloth, etc., and the base 14 and the body wedge 22 may be constructed as a single monolithic unit. An appropriate deodorizing agent can be impregnated within the body member 12.

The body member 12 may be mounted on an appropriate surface, such as a kitchen counter resting directly via the base's flat bottom 16, or, as seen, the body member 12 can be attached to an appropriate base mount 30, in any appropriate fashion such as via adhesion. However, as the body member 12 may need to be replaced from time to time, yet the base mount need not be replaced as often, if at all, a more temporary mounting of the body member 12 onto the base mount 30 may be used, such as having one or more spikes 32 extend upwardly from the base mount 30 and impaling the body member 12 onto the spikes 32.

In order to use the plastic bag drying device, one or more baggies are placed onto the body wedge 22. Specifically, and looking at FIG. 1, a relatively larger baggie BL, say a one gallon capacity baggie, is fitted over the body wedge 22. The tapering of the body wedge 22 allows the baggie BL to be open, with the additional tapering of the base 14 opening the mouth of this baggie BL. The pointed nature of the top edge 24 of the body wedge 22 assures that the bottom of the baggie BL is fully open and able to dry while the pointed nature of the side edges 26 of the body wedge 22 assure that the sides of the baggie BL are open and able to dry. As the body member 12 is made from a moisture absorbent material, the body member 12 absorbs much of the moisture that may be present within the interior of the baggie BL through direct contact with the baggie BL. With the baggie BL held open, the remainder of the moisture within the baggie BL is air dried. If the body member 12 is impregnated with a deodorizing agent, the interior of the baggie BL is also deodorized. Once the baggie BL is dry, it is removed from the plastic bag drying device 10 and used as desired. If the body 12 is sufficiently wet from performing its drying function, it is simply allowed to air dry and then used to dry additional baggies as needed.

Figure 2:
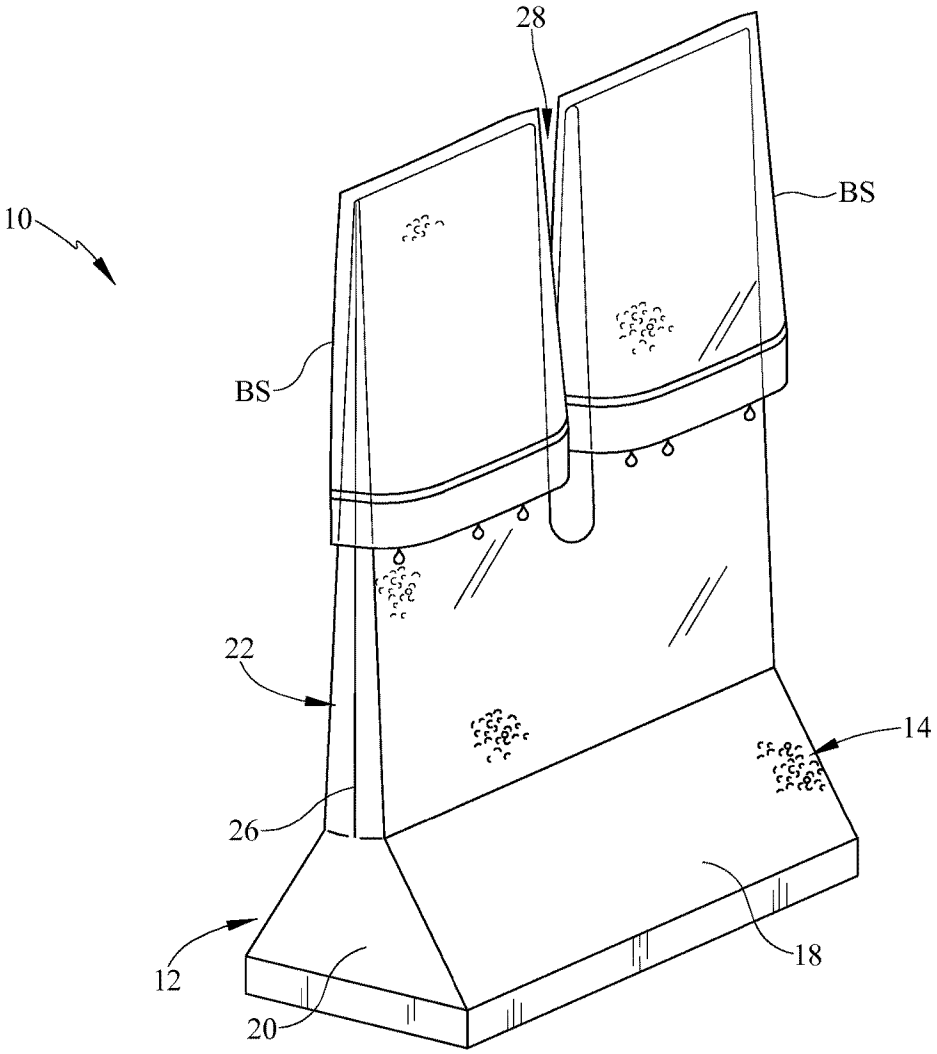
FIG. 2 is a perspective view of the plastic bag drying device drying two relatively smaller plastic bags.
Figure 3:
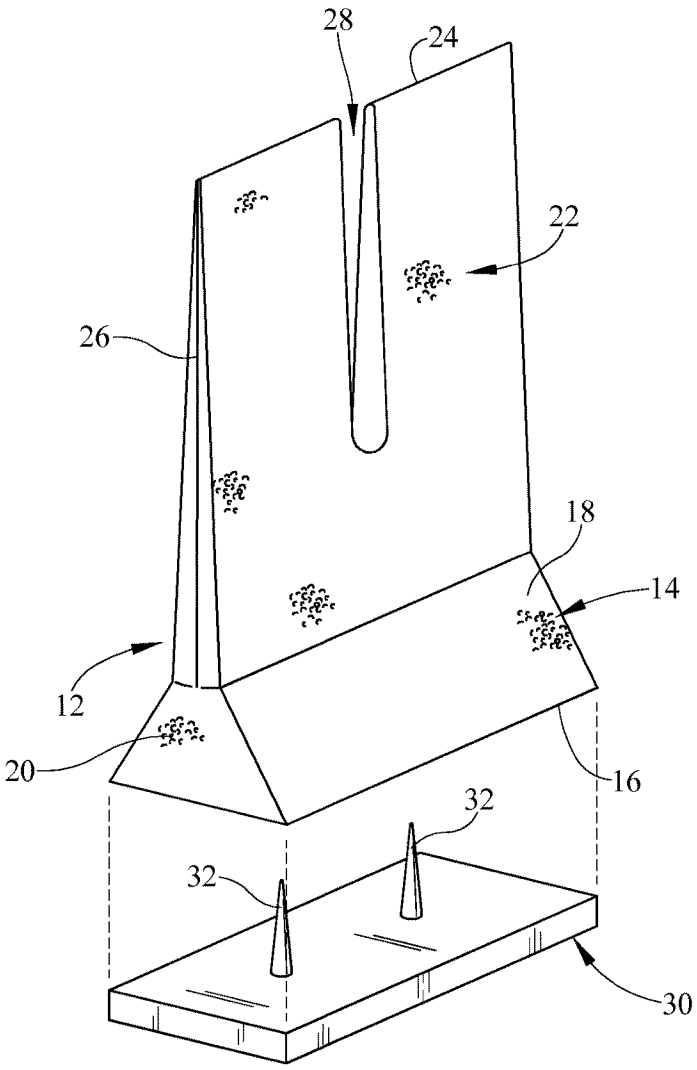
FIG. 3 is an exploded view of the plastic bag drying device.

If relatively smaller baggies are used, such as the illustrated quart sized baggies BS illustrated in FIG. 2, each baggie BS is placed onto the body wedge 22 on one side of the slot 28 and allowed to air dry.

Figure 4:
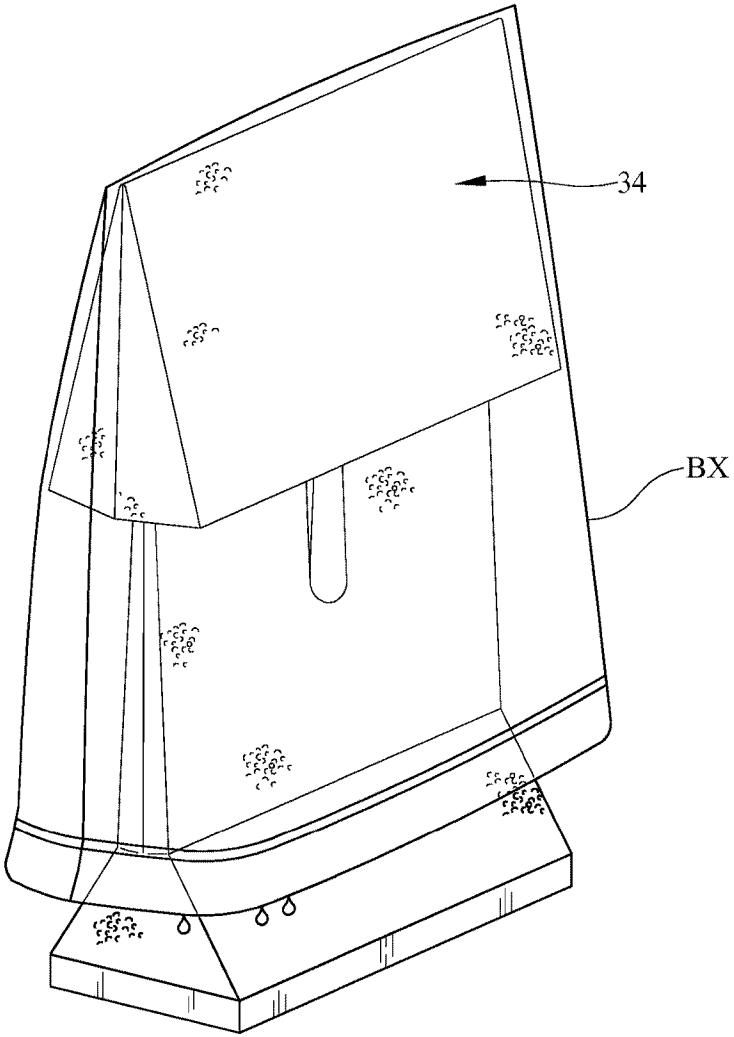
FIG. 4 is a perspective view of the plastic bag drying device with an expander wedge received thereon, drying an even larger plastic bag.
Figure 5:
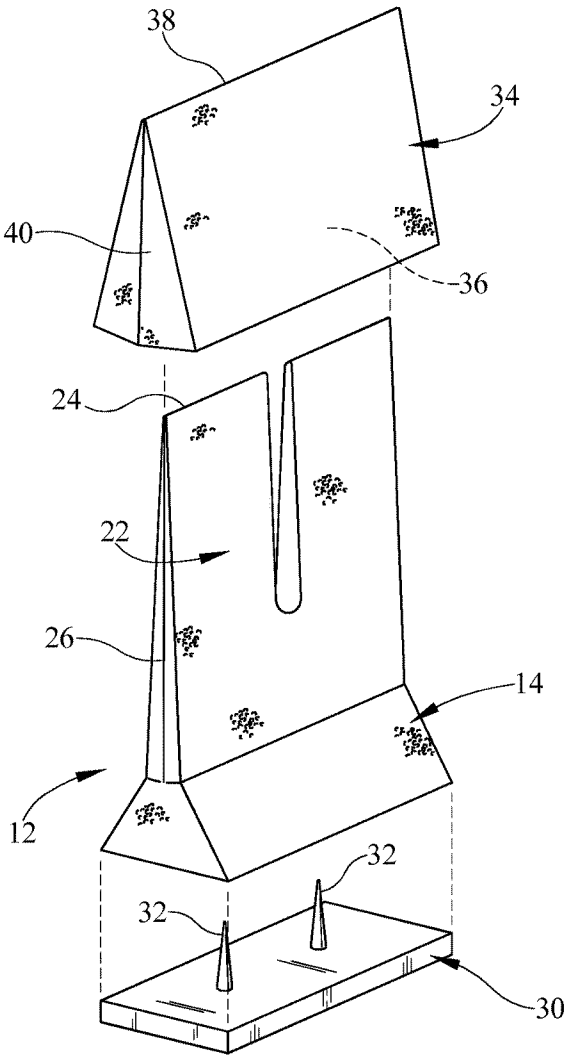
FIG. 5 is an exploded view of the plastic bag drying device with the expander wedge.

If a relatively larger baggie compared to the baggie BL illustrated in FIG. 1, such as two gallon and above sized baggie BX, as illustrated in FIGS. 4 and 5, needs to be dried, then an optional expander wedge 34 is provided. The expander wedge 34 is a wedge shaped member that has an open bottom with an interior cavity 36 that corresponds in shape to the shape of the body wedge 22 and has its own pointed top edge 38 and pointed side edges 40 mimicking the general shape of the body wedge 22. The expander wedge 34 is made from the same or similar material used to make the body 12 and may also be impregnated with a deodorizing agent. The expander wedge 34 is fitted over top the body wedge 22 until it is snug and the baggie BX is placed over the expander wedge 34 and allowed to air dry, again the expander wedge 34 absorbing much of the moisture present within the baggie BX through direct contact. The expander wedge 34 can come in various sizes so that the appropriate sized expander wedge 34 is selected to fit atop the body wedge 22 based on the size of the baggie to be dried.

Of course, in lieu of the slot 28 and/or the expander wedge 34, the plastic bag drying device 10 can be made in various sizes, each size corresponding to a particular size of baggie to be dried.

While the invention has been particularly shown and described with reference to an embodiment thereof, it will be appreciated by those skilled in the art that various changes in form and detail may be made without departing from the spirit and scope of the invention.

I claim:

1. A plastic bag drying device comprising:

a base having a flat first bottom adapted to gravitationally rest on a flat surface, a pair of opposing side faces that taper upwardly and inwardly from the first bottom and toward each other and joined by a pair of opposing end faces that taper upwardly and inwardly from the first bottom and toward each other; and a wedge shaped body wedge extending upwardly from a top of the base, the body wedge having a pointed first top edge and a pair of first side edges wherein the base and the body wedge are each made from a sponge material and being adapted to support and hold open a plastic bag.

2. The plastic bag drying device as in claim 1 wherein the sponge material is impregnated with a deodorizing agent.

3. The plastic bag drying device as in claim 1 wherein a slot extends from the first top edge of the wedge body toward the base.

4. The plastic bag drying device as in claim 1 wherein the base is mounted on a base mount.

5. The plastic bag drying device as in claim 1 further comprising a wedge shaped expander wedge having a second bottom, a pointed second top edge and a pair of pointed second side edges such that the expander wedge is seated atop the body wedge.

6. The plastic bag drying device as in claim 5 wherein the expander wedge is made from a moisture absorbent material.

7. The plastic bag drying device as in claim 6 wherein the moisture absorbent material is sponge.

8. The plastic bag drying device as in claim 6 wherein the moisture absorbent material is foam.

9. A plastic bag drying device comprising:

a base having a flat first bottom adapted to gravitationally rest on a flat surface, a pair of opposing side faces that taper upwardly and inwardly from the base and toward each other, and a pair of opposing end faces that taper upwardly and inwardly from the base and toward each other and join the pair of opposing side faces; and a wedge shaped body wedge extending upwardly from a top of the base, the body wedge having a pointed first top edge and a pair of first side edges wherein the base and the body wedge are each made from a foam material and being adapted to support and hold open a plastic bag.

10. The plastic bag drying device as in claim 9 wherein the foam material is impregnated with a deodorizing agent.

11. The plastic bag drying device as in claim 9 wherein a slot extends from the first top edge of the wedge body toward the base.

12. The plastic bag drying device as in claim 9 wherein the base is mounted on a base mount.

13. The plastic bag drying device as in claim 9 further comprising a wedge shaped expander wedge having a second bottom, a pointed second top edge and a pair of pointed second side edges such that the expander wedge is seated atop the body wedge.

14. The plastic bag drying device as in claim 13 wherein the expander wedge is made from a moisture absorbent material.

15. The plastic bag drying device as in claim 14 wherein the moisture absorbent material is sponge.

16. The plastic bag drying device as in claim 14 wherein the moisture absorbent material is foam.

17. A plastic bag drying device comprising:

a base having a flat first bottom adapted to gravitationally rest on a flat surface, a pair of opposing side faces that taper upwardly and inwardly from the base and toward each other, and a pair of opposing end faces that taper upwardly and inwardly from the base and toward each other and join the pair of opposing side faces; and a wedge shaped body wedge extending upwardly from a top of the base, the body wedge having a pointed first top edge and a pair of first side edges wherein the base and the body wedge are each made from a moisture absorbent material that is impregnated with a deodorizing agent and being adapted to support and hold open a plastic bag.

18. The plastic bag drying device as in claim 17 wherein a slot extends from the first top edge of the wedge body toward the base.

19. The plastic bag drying device as in claim 17 wherein the base is mounted on a base mount.

20. The plastic bag drying device as in claim 17 further comprising a wedge shaped expander wedge having a second bottom, a pointed second top edge and a pair of pointed second side edges such that the expander wedge is seated atop the body wedge.

21. The plastic bag drying device as in claim 20 wherein the expander wedge is made from a moisture absorbent material.

22. The plastic bag drying device as in claim 21 wherein the moisture absorbent material is sponge.

23. The plastic bag drying device as in claim 21 wherein the moisture absorbent material is foam.

* * * * *